United States Patent [19]

Giuffredi

[11] 4,216,884

[45] Aug. 12, 1980

[54] AEROSOL DISPENSING VALVES

[75] Inventor: Giancarlo Giuffredi, Milan, Italy

[73] Assignee: Coster Tecnologie Speciali S.p.A., Milan, Italy

[21] Appl. No.: 946,806

[22] Filed: Sep. 28, 1978

[30] Foreign Application Priority Data

Sep. 17, 1977 [IT] Italy ..... 29763 A/77

[51] Int. Cl.[2] ..... B65D 83/14

[52] U.S. Cl. ..... 222/402.16

[58] Field of Search ..... 222/402.16, 402.24, 222/394; 141/3

[56] References Cited

FOREIGN PATENT DOCUMENTS 2556164 6/1977 Fed. Rep. of Germany ..... 222/402.16

1362885 8/1974 United Kingdom ..... 222/402.16

*Primary Examiner*—Stanley H. Tollberg

[57] ABSTRACT

Improvements in or relating to an aerosol dispensing valve comprising a body of resilient plastics material connected to a rigid or metal cup for connection to a container (bottle), a partially hollow stem provided with transverse holes, movable against a spring in the tubular body, and partially projecting from the latter through a passage in the cup, and a resilient annular seal or gasket located between the cup and tubular body and, at inoperative condition of the valve, shutting off the communication between the inside and outside of the container or bottle and against which the end of the body adheres. At the end portion of the tubular body facing the cup and externally of the body a crown gear having inclined lower face is provided which adheres against a continuous inclined surface of an inner projection of the cup.

1 Claim, 3 Drawing Figures

AEROSOL DISPENSING VALVES

This invention is concerned with improvements in or relating to aerosol dispensing valves, so that such valves can use carbon dioxide as a propellant.

The prior art aerosol dispensing valves have been designed to operate with propellants on the ground of halogenated hydrocarbons which may be harmful to health. Therefore, there is the tendency to use other undoubtedly harmless propellants, such as carbon dioxide. However, the prior art dispensing valves do not allow a fast charging of carbon dioxide, and accordingly it is the object of the present invention to improve such a type of valves, so as to be suitable for this different type of propellant.

The improvements brought in a valve of the type comprising a tubular body of resilient plastics material connected to a rigid or metal cup for connection to a container (bottle), a partially hollow stem provided with transverse holes, movable against a spring in such a tubular body and partially projecting from the latter through a passage in the metal cup, and a resilient annular seal or gasket located between said cup and cylindrical body and, when the valve is inoperative, shutting off the communication between the inside and outside of the container, and against which the end of said cylindrical body adheres, wherein at the end portion of the tubular body facing the cup and externally of said body a crown gear is provided having its inclined lower face or underside adhering against a continuous as well inclined surface of an inner projection of the cup, so that as a whole under the action of a sufficient push exerted on said tubular body in a direction inwardly of the container, the end of said body is moved away from the resilient annular seal or gasket and, as a result, a passage is formed between the outside and inside of the container, with elastic deformation of said end portion of the tubular body tending to return the latter back to original position.

The invention will be more clearly understood form the following detailed description given by mere way of unrestrictive example of a preferred embodiment thereof, as shown in the accompanying drawings, in which.

Figure 2:
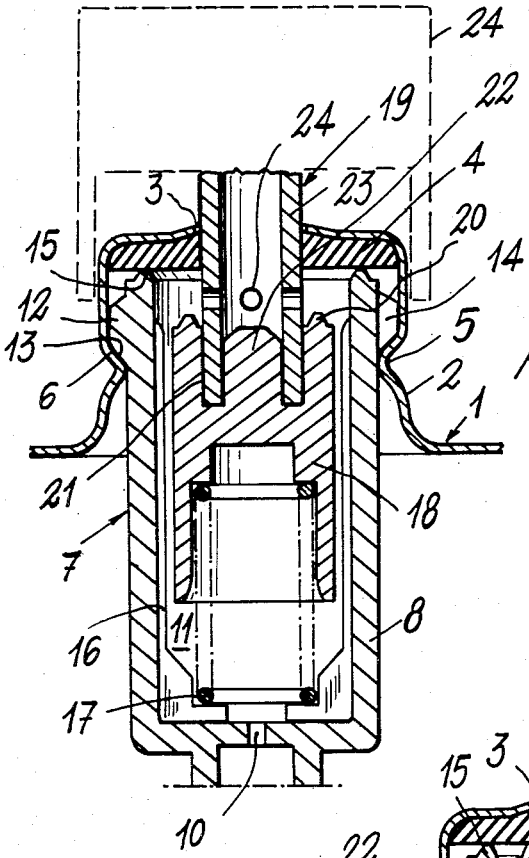
FIG. 2 is still an axial sectional view showing the same valve at dispensing position.

Referring to the figures of the accompanying drawings, reference numeral 1 denotes the metal cup, supporting the valve and also serving to connect it with the container (bottle), therein containing the product to be dispensed together with the propellant.

Metal cup 1 has a central raised portion 2 provided with a bore or passage 3. The inner face of this raised portion 2 has a resilient annular seal or gasket 4 applied thereto. At some height of said portion 2, a rim 5 is provided, on its inner side having an inclined continuous surface 6. Inter alia, rim 5 is effective to hold valve 7 in connected relationship with the metal cup.

Valve 7 comprises an outer tubular body 8 of resilient plastics material, such as polyethylene, provided with an extention 9, internally or externally of which a conventional drawing tube, not shown, can be inserted and communicates through a hole 10 of a comparatively reduced diameter with a chamber 11 defined by body 8.

At its top end portion facing cup 1 and at the outside, said tubular body 8 has a crown gear 12 provided with an inclined lower face 13. The inclination is substantially coincident with that of surface 6 of said inner rim 5. The spacings or voids between the teeth are indicated at 14.

Figure 1:
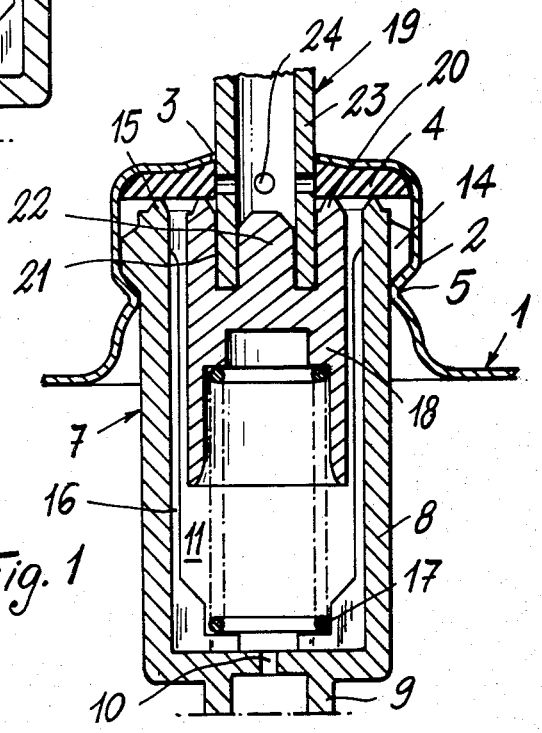
FIG. 1 is an axial sectional view showing the valve at inoperative position.
Figure 3:
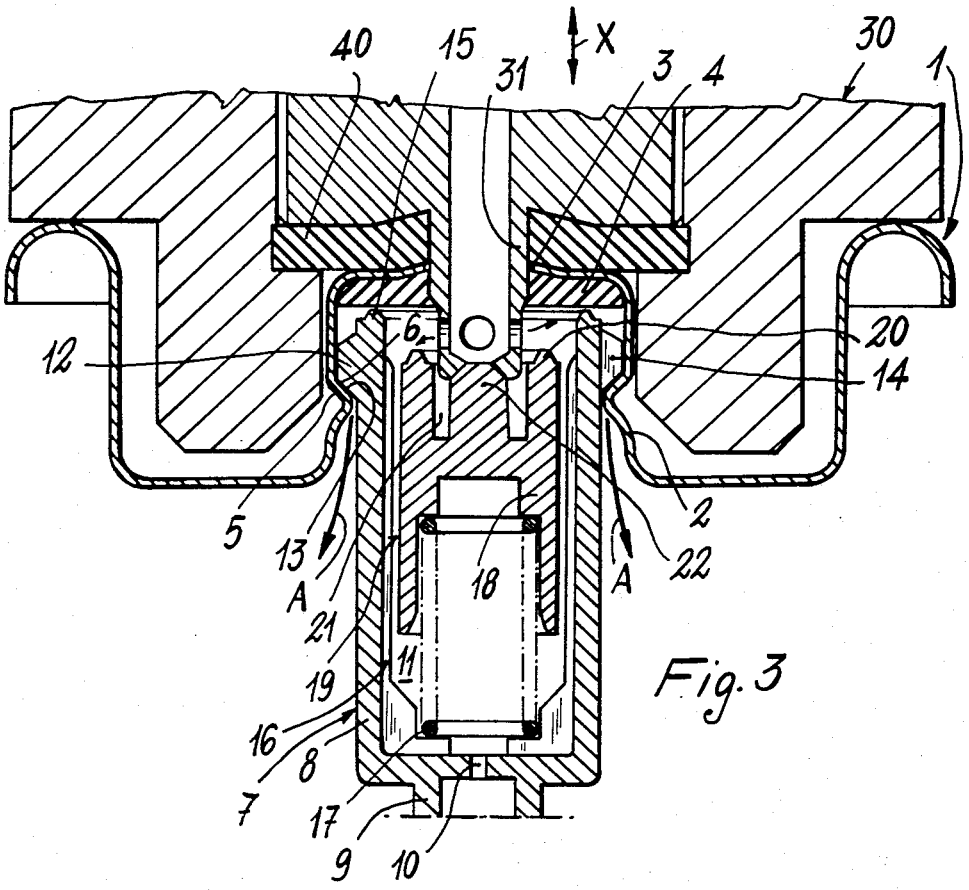
FIG. 3 shows the valve at propellant ($CO_2$) charging step, that is the introduction of the latter into the container.

Inclined faces 13 of teeth 12 adhere against inclined surface 6 of rim 5 and, under all the operative conditions for the valve except the charging condition shown in FIG. 3, a trapezoidal side or edge 15 provided at the top end of body 8 sealingly adheres against seal or gasket 4, as shown in FIGS. 1 and 2.

The inner wall of chamber 11 is provided with longitudinal spaced apart parallel ribs 16 radially extending on the bottom of the chamber. Internally fo chamber 11, a cylindrical element 18 forming part of the so-called stem, designated as a whole at 19, is slidably mounted against a compression spring 17.

At the top end said cylindrical element 18 has a side 20 of trapezoidal cross-section which, at the inoperative position of the valve (FIG. 1), sealingly adheres against seal or gasket 4 under the action of spring 17 and pressure prevailing within the container. Element 18 also has an upper annular groove 21 defining a projection 22 on which a tube 23 is threaded as provided with transverse holes 24 and also forming part of stem 19. A conventional dispensing button 24 is threaded or slipped on this tube 23, the lower face of which, upon abutting with cup 1, will limit the downward stroke of stem 19, preventing an undue push from being applied on tubular body 8.

When the product is to be dispensed, the user downward depresses said button 24, thereby lowering stem 19 against spring 17 and accordingly separating side 20 from seal or gasket 4 and displacing transverse holes 24 to below the lower face of said seal or gasket 4. Therefore, the fluid can flow to the outside by passing through the drawing tube, hole 10, chamber 11, holes 24, axial conduit of tube 23, and usual passages in said dispensing button 24.

When desiring to fil up or charge the bottle with $CO_2$, which occurs when the specific product (such as hair lac) has been already introduced into the bottle in a step prior to applying said cup 1 to the bottle, tube 23 of stem 19 is not yet arranged in place. A conventional charging head 30, movable in direction X and connected with a $CO_2$ supply, is lowered to the bottle, to which said cup 1 with valve 7 is connected. A perforated extention 31 of head 30 passes through the opening of seal or gasket 4 and, by adhering against projection 22, inwardly displaces said cylindrical element 18 against spring 17 At this position, a seal or gasket 40 in head 30 adheres on raised portion 2 of cup 1. Thus, pressurized $CO_2$ is allowed to reach chamber 11, therefore arriving at the bottle through hole 9 of reduced diameter. As a result, a substantial downward push is exerted on body 8 (deriving from the pressure differential and pressing action of extension 31). This push causes side 15 to be moved away from seal or gasket 4 and the resilient contraction of the top portion of body 8 as a result of inclined lower faces 13 sliding along inclined surface 6 of rim 5. Thereby, an additional passage is built up for $CO_2$ introduction into the bottle. Such a passage is indicated by arrows A and is concerned with spacings or voids 14 between teeth 12. Upon attaining the pressure balance, in inflow of $CO_2$ is discontinued and a downward push is exerted on body 8 due to the action of extension 31 and an opposite push due to the elastic force by which the contracted end of body 8 tends to return back to the original shape, causing inclined surfaces 6, 13 to slide to one another. If the latter push is larger than the former, body 8 upward moves and with its end 15 sealingly adheres against seal or gasket 4. On the other hand, should the former push exceed the latter, the additional passage would remain open. However, in both of said cases, each passage is shut off when cup 1 is lifted.

Then, tube 23 is applied. This readily carried out operation causes but a minimum dispensing of the product.

What I claim is:

1. An improved aerosol dispensing valve, comprising: a tubular body of resilient plastic material with a closed end and having a crown gear formed externally at the open end of the body, said body including a sealed surface at the rim of the open end, said body having a cylindrical tubular extension from the outside of the closed end and a hole on the closed end between the inner portion of the cup and the bore of said tubular extension, the inner cylindrical surface of said body having longitudinal ribs;

a rigid metal cup for connection to an aerosol container, said cup having a central hole in the closed end and having flanges extending from the open end of the metal cup to provide for said connection;

a resilient annular gasket located in said cup surrounding said central hole and completely filling the closed end of said cup, said metal cup being crimped about said crown gear on said body so as to provide mechanical pressure between said sealing rim on said body and said resilient sealing gasket;

a discharge tube having an outer diameter such that said tube fits closely within said central hole in said metal cup and is circumferentially sealed by said resilient annular gasket, said discharge tube having transverse holes near one end thereof, said holes being of smaller diameter than the thickness of said annular gasket;

a cylindrical element which is slidingly installed inside said body, said cylindrical element having an annular sealing surface on the end thereof which is closer to the open end of said body, said cylindrical body being adapted to receive an end of said discharge tube within the annulus of said sealing surface, said cylindrical element having a recess at the end opposite said sealing surface; and resilient biasing means adapted to be retained by said recess in said cylindrical element and to bias said cylindrical element away from the closed end of said body, wherein in the closed condition of the valve, said cylindrical element is biased against said resilient annular gasket to provide a seal around the annulus of said gasket and the transverse holes in said discharge tube are located so as to be occluded by the thickness of said resilient annular gasket, the valve being opened by forcing said discharge tube against the action of said cylindrical element permitting the inner portion to communicate with said tube through said transverse holes, and providing additional flowing passages by forcing said discharge tube and cylindrical element against the closed end of said cup with sufficient force to provide elastic deflection of said crimp about said crown gear so that said seal between the rim of said body and said resilient gasket is interrupted, permitting flow around the rim of said body and between the teeth of said crown gear.

* * * * *